US008522892B2

(12) United States Patent
Lemelin

(10) Patent No.: US 8,522,892 B2
(45) Date of Patent: Sep. 3, 2013

(54) IMPACT DEVICE WITH INTERCHANGEABLE TOOL

(76) Inventor: Normand Lemelin, Lakeland, FL (US)

( * ) Notice: Subject to any disclaimer, the term of this patent is extended or adjusted under 35 U.S.C. 154(b) by 324 days.

(21) Appl. No.: 12/618,131

(22) Filed: Nov. 13, 2009

(65) Prior Publication Data

US 2011/0113929 A1 May 19, 2011

(51) Int. Cl.
*B25D 1/16* (2006.01)

(52) U.S. Cl.
USPC ..... 173/90; 173/91; 173/92

(58) Field of Classification Search
USPC ..... 173/90, 91, 92, 115; 144/195.5, 144/93, 193; 30/367, 164.6, 277
See application file for complete search history.

(56) References Cited

U.S. PATENT DOCUMENTS

| | | | | | |
|---|---|---|---|---|---|
| 2,970,592 | A | * | 2/1961 | David | 606/238 |
| 3,036,482 | A | * | 5/1962 | Kenworthy et al. | 173/90 |
| 3,499,497 | A | * | 3/1970 | Moore | 173/129 |
| 3,519,234 | A | * | 7/1970 | Matson | 248/156 |
| 3,712,389 | A | * | 1/1973 | Smoak | 173/126 |
| 4,101,088 | A | * | 7/1978 | Stauth | 242/396.1 |
| 4,241,795 | A | * | 12/1980 | Landry, Jr. | 173/90 |
| 4,308,903 | A | * | 1/1982 | Alloway | 144/195.5 |
| 4,327,787 | A | * | 5/1982 | Loratto | 144/195.5 |
| 4,350,192 | A | * | 9/1982 | Dent | 144/195.5 |
| 4,362,194 | A | * | 12/1982 | Lawson | 144/193.1 |
| 4,405,005 | A | * | 9/1983 | Zanker | 144/195.5 |
| 4,431,040 | A | * | 2/1984 | Friedrich et al. | 144/195.5 |
| 4,458,415 | A | * | 7/1984 | Maher et al. | 30/164.6 |
| 4,470,440 | A | * | 9/1984 | Thor | 144/195.5 |
| 4,577,667 | A | * | 3/1986 | Gray et al. | 144/195.5 |
| 4,646,799 | A | * | 3/1987 | Cobb | 144/195.3 |
| 4,813,494 | A | * | 3/1989 | Beard et al. | 173/91 |
| 5,086,849 | A | * | 2/1992 | Dahl | 173/126 |
| 5,123,303 | A | | 6/1992 | Lee | |
| 5,174,388 | A | * | 12/1992 | Williams et al. | 173/1 |
| 5,315,724 | A | | 5/1994 | Trujillo | |
| 5,495,878 | A | * | 3/1996 | McKenen, Jr. | 144/195.5 |
| 5,542,479 | A | * | 8/1996 | Stachler et al. | 173/90 |
| 5,671,814 | A | * | 9/1997 | Smith | 173/91 |
| 5,768,785 | A | * | 6/1998 | Pessin | 30/164.6 |
| 5,810,333 | A | * | 9/1998 | Hickerson et al. | 254/93 R |
| 5,934,139 | A | * | 8/1999 | Tucker | 72/479 |
| 5,996,705 | A | * | 12/1999 | Downs | 172/371 |
| 6,109,365 | A | * | 8/2000 | Lamoureux et al. | 173/90 |
| 6,718,586 | B2 | | 4/2004 | Corsini | |
| 7,089,694 | B2 | * | 8/2006 | Allen | 40/607.04 |
| 2004/0108121 | A1 | * | 6/2004 | Lowther | 173/90 |
| 2004/0154812 | A1 | * | 8/2004 | McDonald | 173/90 |

FOREIGN PATENT DOCUMENTS

EP 516343 A1 * 12/1992

* cited by examiner

*Primary Examiner* — Brian D Nash
(74) *Attorney, Agent, or Firm* — Daniel Law Offices, P.A.; Jason T. Daniel, Esq.

(57) ABSTRACT

An apparatus and method of manufacturing the same are disclosed for an impact device with interchangeable tools for applying precise momentum force to an external object. The device includes two elongated members, one of which containing a hollow portion, and a tool head disposed on one side of the first elongated member. The device can be configured to allow the first elongated member to be removably inserted into the second elongated member and to allow the second elongated member to strike the tool head in order to impart force on an external object.

14 Claims, 8 Drawing Sheets

IMPACT DEVICE WITH INTERCHANGEABLE TOOL

BACKGROUND

1. Field of the Invention

The present invention relates generally to a hand operated impact device containing a guided ram for applying precise momentum force to a plurality of interchangeable tools.

2. Background of the Invention

With the recent boom in housing and real estate development, many companies are operating at maximum capacity to keep up with the demand for their services. As such, these companies employ workers for performing various construction and labor related tasks such as installing new underground facilities (i.e. cable, telephone, sprinklers, etc), compacting earth and stripping roof tiles to name a few. To accomplish the work, these companies must provide their workers with several hand tools such as axes, shovels, hedgers, and compactors among others. In addition, many of these companies have divisions which work on large machinery and must further provide employees with specialized slugging wrenches, sledges and other such tools. In each of these instances, the tools are utilized by imparting manual force through the tool to the object being worked on. In a typical example, a worker attempting to dig a trench must step on top of a shovel or swing a trench cutter (also known as a womper) or axe several times into the ground in order to make a hole. In addition to the physical exertion and inaccuracy caused by constantly swinging a heavy tool, workers often suffer injuries resulting from inadvertent contact with the tool in motion.

Several patents have been granted for impact type tools including: Lee U.S. Pat. No. 5,123,303; Corsini U.S. Pat. No. 6,718,586; and Trujillo U.S. Pat. No. 5,315,724, however, none of these address the issues outlined above.

SUMMARY OF THE INVENTION

The present invention is directed to an impact device containing a guided ram for applying precise momentum force to an interchangeable tool. One object of the present invention is to provide a single impact device with a series of interchangeable tools capable of replacing several conventional construction tools and improving efficiency and safety of workers. Accordingly, one embodiment of the present invention can include two elongated members, one of which containing a hollow portion, and a tool head disposed on one side of the first elongated member. The device can be configured to allow the first elongated member to be removably inserted into the second elongated member, and to allow the second elongated member to strike the tool head in order to impart precise momentum force on an external object.

Yet another embodiment of the present invention can include a method of manufacturing an impact device as described above.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
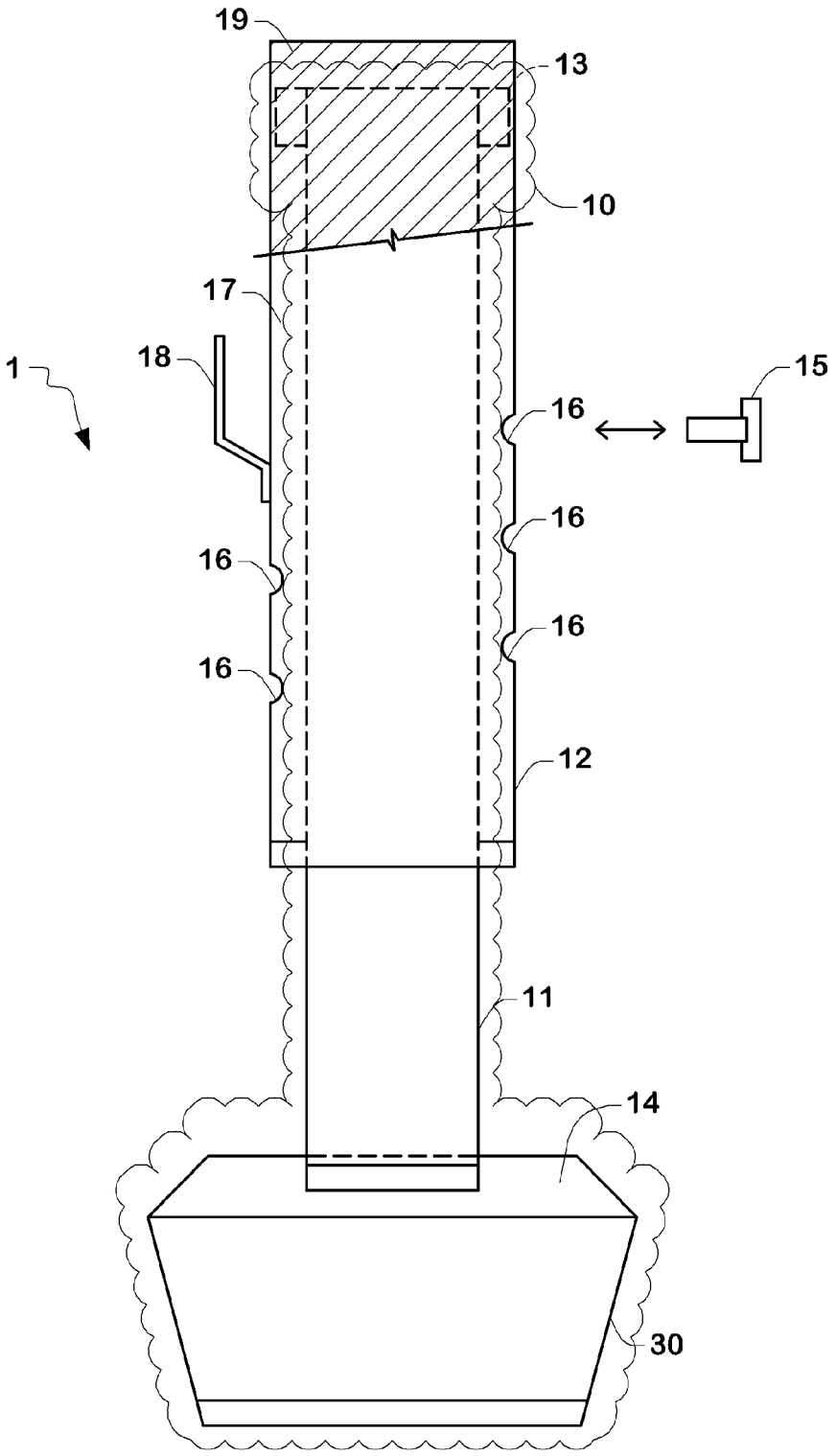
FIG. 1 is a frontal view of an impact device with an interchangeable tool according to one embodiment of the present invention.

FIG. 1 illustrates a general architecture of an impact device 1 that includes an interchangeable tool 10 and a guided Ram 12 capable of imparting substantial momentum force to the tool. As shown in FIG. 1, the interchangeable tool 10 includes an elongated base member 11 preferably constructed of strong bar-like steel with protrusions 13 disposed at one end and an impact plate 14 disposed at the opposite end.

The impact plate 14 is positioned between the bottom of the base member 11 and the top of the tool head 30. The impact plate 14 is preferably a rectangular plate constructed of hardened reinforced steel having a large surface area that is parallel to a location in which the bottom of the tool head 30 is to be applied. As such, the impact plate may be permanently and securely affixed between the base member and the tool head via a weld or may be molded with the base member and the tool head at the factory to produce a continuous steel component. Alternatively, the tool head 30 may be removably secured to the impact plate 14 using any known attachment method such as screws or bolts. In one embodiment, an optional rubberized sound absorbing material may be placed on top of the impact plate 14 to reduce noise from the device when in use.

The Ram 12 is preferably constructed of strong reinforced heavy bar-like steel and includes a hollow portion 17 centered within the Ram 12 into which the base member 11 can be inserted. The diameter of the hollow portion of the Ram 12 can be slightly larger than the diameter of the outer portion of the base member 11 and the protrusions 13 to allow the Ram 12 to slide up and down the length of the base member 11. A suitable securing means 15 can be secured to the body of the Ram 12 through any one of the holes 16. Moreover, the Ram 12 may be provided with optional safety features such as a handle 18 and a rubberized grip 19 to allow better grip and to protect against electrocution in the event the device inadvertently makes contact with a live power wire. In an alternate embodiment, the Ram 12 may be constructed to include additional weight for imparting maximum momentum force. Additionally, in one embodiment both the base member 11 and the Ram 12 can be of equal lengths, however, it is preferred that the base member 11 be shorter than the Ram 12.

Figure 2:
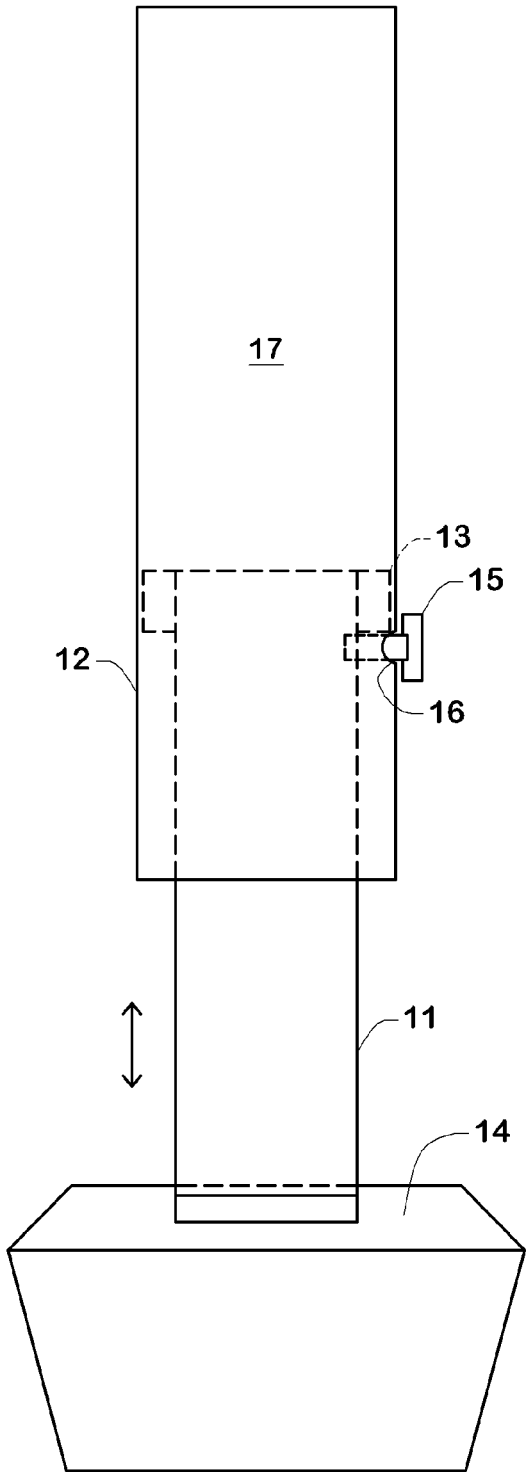
FIG. 2 is another frontal view of an impact device with an interchangeable tool according to one embodiment of the present invention.

As illustrated in FIG. 2, the securing means 15 can be removably attached to the ram such that one end of the securing means can interact with at least one of the protrusions 13 to form a ram stop. To this end, when the Ram 12 is extended upward with respect to the base member 11, the securing means 15 can make contact with one of the protrusions 13 to prevent the ram from separating from the base member. Moreover, as the Ram 12 includes several holes 16 through which the securing means 15 can be placed, a user can select the position that works best for the job at hand (i.e. low overhang, or adjust for height of worker). In another embodiment, the securing means may extend to make contact directly with the base member 11 such that the Ram 12 is prevented from moving. Such a feature would be particularly helpful when carrying the device. As would be understood by one of skill in the art, the securing means 15 may be any form of robust metal and may take the shape of a removable rivet, bolt, pin or the like.

The tool head of the present invention can take any one of several different shapes as will be described with reference to the figures below. However, in each instance the specific tool head will be affixed to the bottom the impact plate 14 of the tool 10 as described above.

Figure 3:
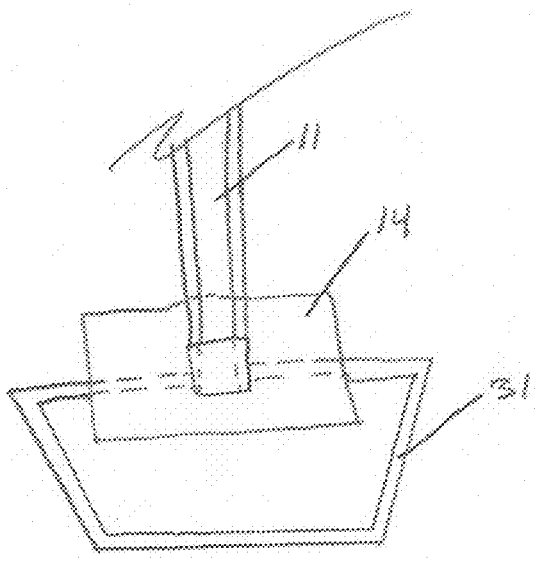
FIG. 3 is a side view of a tool head according to one embodiment of the present invention.

Accordingly, in one embodiment, the tool head may take the form of a cable burier as illustrated in FIG. 3. The cable burier tool head 31 may be a solid steel blade that can penetrate dirt or grass with the application of pressure. The cable burier tool head 31 may preferably have a dimension of 8×14" to allow a user to dig a trench with a consistent depth. However, as would be readily appreciated by one of skill in the art, the cable burier can be sized for specific applications. For instance, in several municipalities, low voltage (i.e. telephone and cable) wiring must be placed 6 inches below ground. As such, the dimension of the cable burier tool head 31 can be 6×12 to accommodate particular industries.

In operation, the device 1 according to one embodiment can be used to safely and accurately impact momentum force from the Ram 12 to the tool 10 in order to dig a trench for the placement of underground utilities or other needed items. To this end, a user can place the bottom of the tool head 31 on the ground in a location where a trench is needed and raise the Ram 12 until the securing means 15 makes contact with the protrusion 13 (see FIG. 2).

Figure 4:
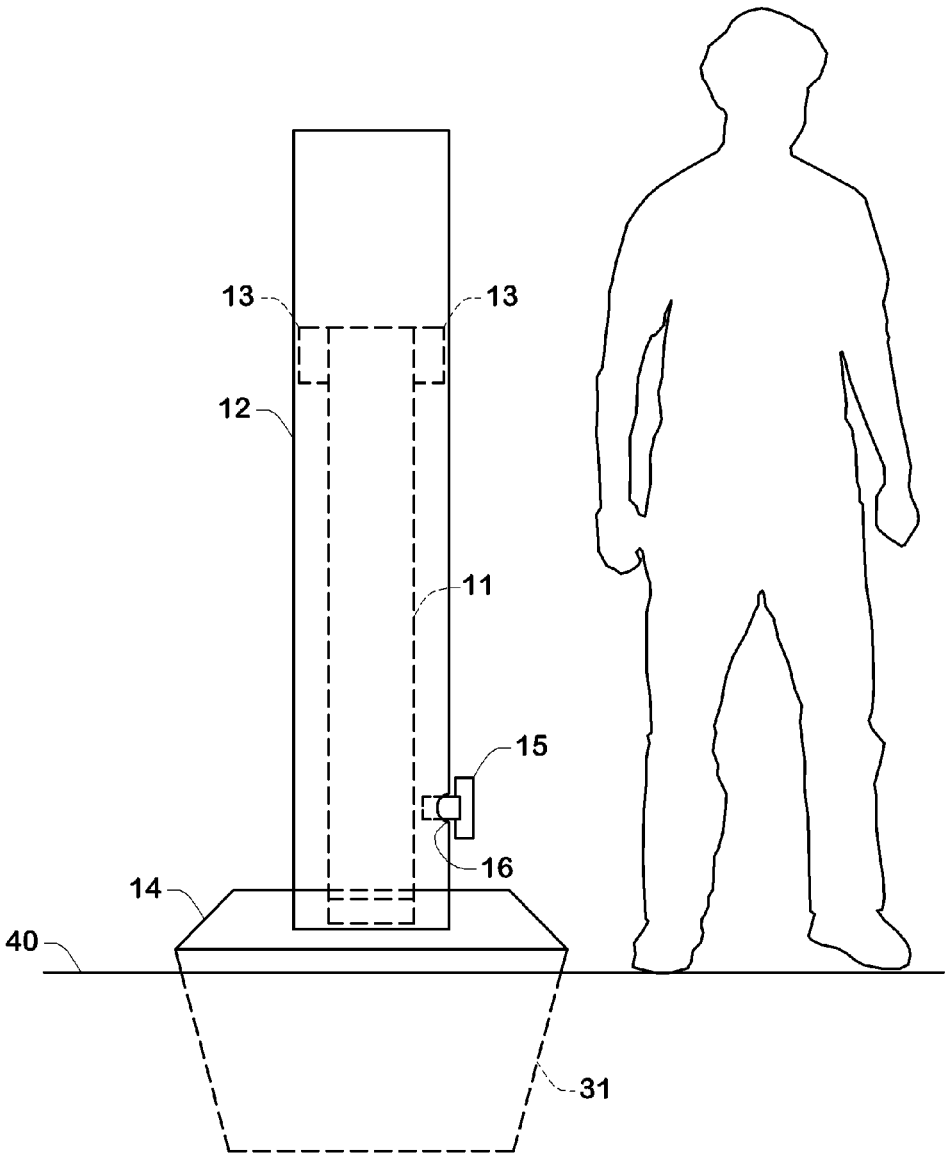
FIG. 4 is a frontal view of an impact device with an interchangeable tool in use according to one embodiment of the present invention.

As illustrated in FIG. 4, the user can propel the ram in a downward motion until the bottom of the ram strikes the impact plate 14. The momentum force associated with one or more ram strikes will cause the cable burier 31 to penetrate the ground until the bottom of the tool head reaches a desired depth or until the bottom of the impact plate 14 makes contact with the ground. Moreover, as the tool 10 remains stationary (i.e. is not lifted from the ground with each strike) the present embodiment allows the device to precisely apply momentum force to the same location with each strike of the ram. This feature greatly reduces fatigue caused from inaccurate strikes by a conventional tool as well as significantly reducing the potential for injuries to workers resulting from unexpected contact with a conventional tool.

Figure 5:
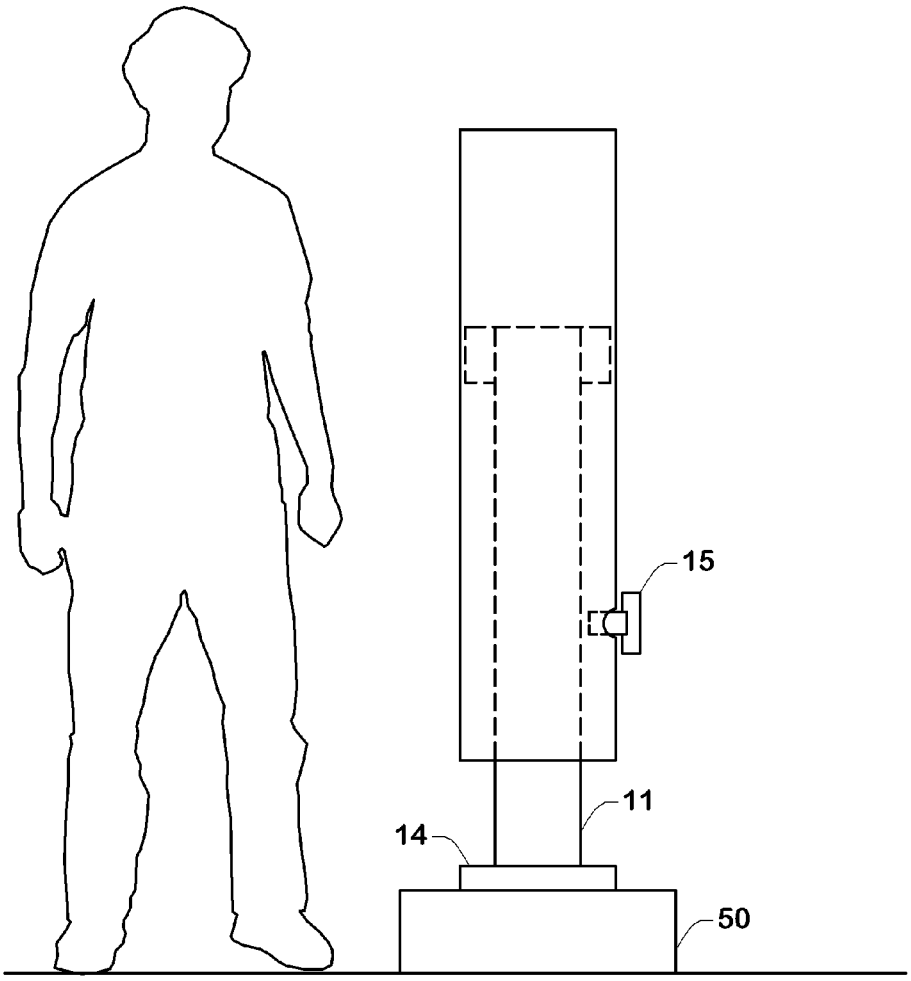
FIG. 5 is a front view of a compactor tool according to an alternate embodiment of the present invention.

Although the above embodiments describe the tool head of the device with respect to a cable burier, the invention is not so limited. For instance, FIG. 5, illustrates an alternative embodiment of the device of FIG. 1 that includes a compactor tool head 50. In this embodiment, the compactor tool head 50 can consist of a heavily weighted square steel plate having a large surface area for flattening the ground when force is applied to the top of the impact plate 14 by the bottom of the Ram 12 through the process described above.

Figure 6:
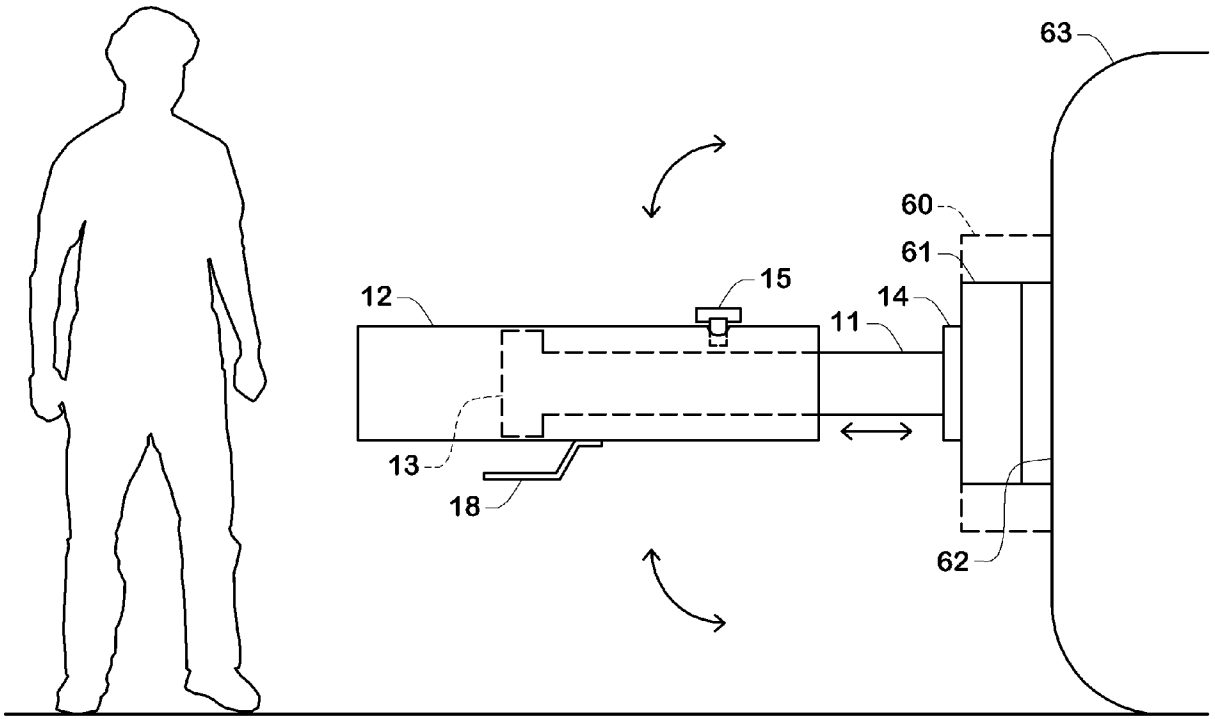
FIG. 6 is a front view of a magnetized pounder tool according to an alternate embodiment of the present invention.

FIG. 6. illustrates another alternative embodiment of the device of FIG. 1 that includes a magnetized pounder tool head 60. In this embodiment, the magnetized pounder tool head 60 can consist of a heavily weighted square plate 61 and a magnetized portion 62 to allow the device to be applied at a perpendicular angle to metallic objects 63. For instance, when working on large equipment or other such machinery, a worker can position the magnetized pounder tool head 60 of the device 1 perpendicular to any angle that the object 63 is located. As the head of the pounder tool is magnetized, the device will attach to the object, where a momentum force can be impacted from the Ram 12 without damaging parts.

Figure 7:
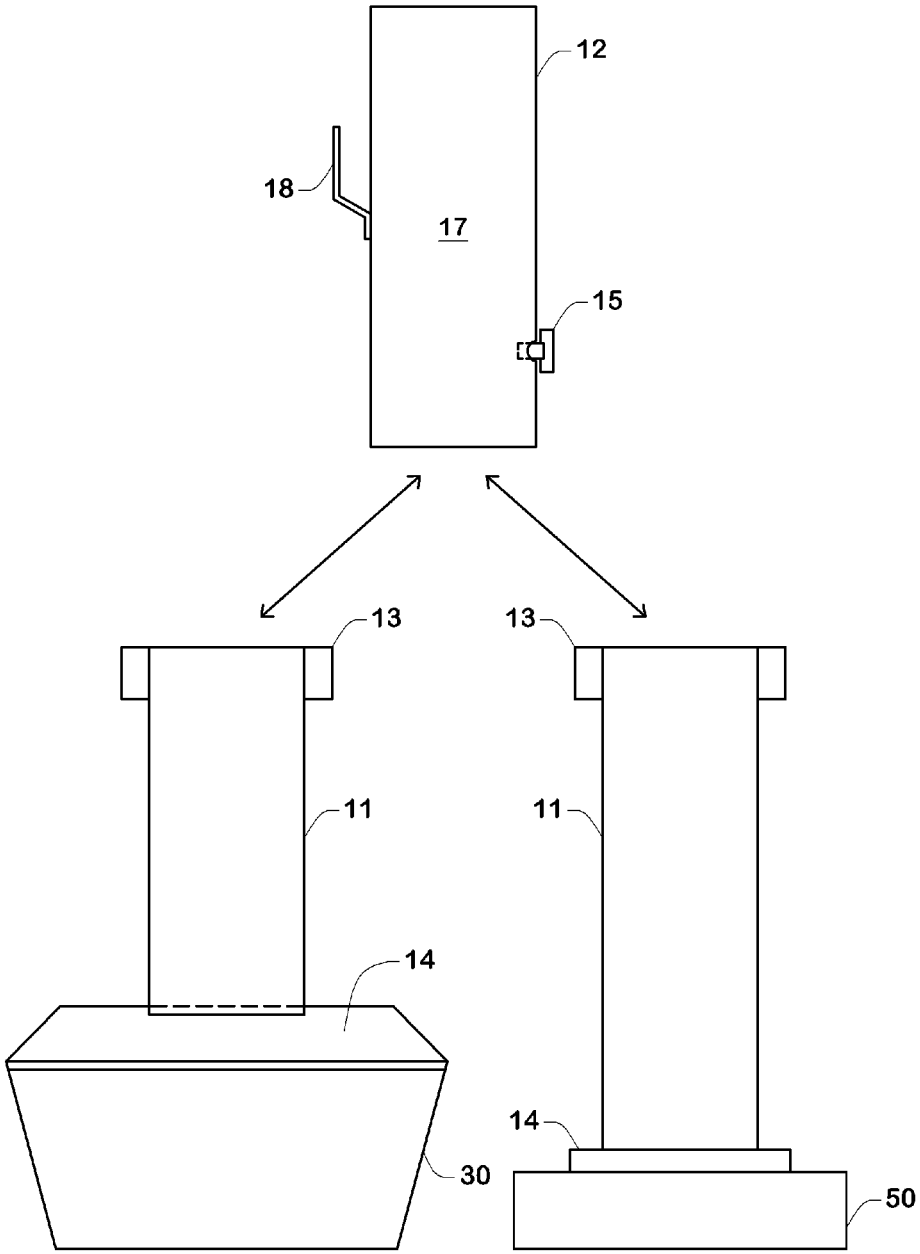
FIG. 7 is a front view of the device with an interchangeable tool according to an one embodiment of the present invention.
Figure 8:
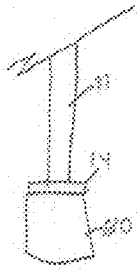
FIG. 8 is a front view of an axe tool according to an alternate embodiment of the present invention.
Figure 9:
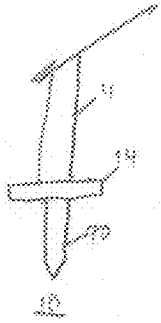
FIG. 9 is a front view of a chisel tool according to an alternate embodiment of the present invention.
Figure 10:
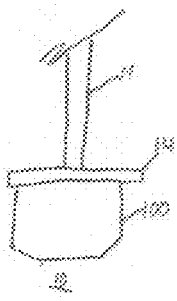
FIG. 10 is a front view of a hedger tool according to an alternate embodiment of the present invention.
Figure 11:
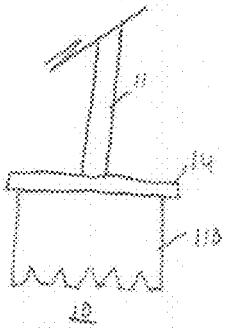
FIG. 11 is a front view of a tile stripper tool according to an alternate embodiment of the present invention.
Figure 12:
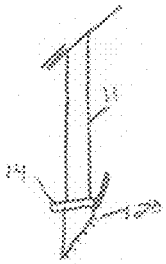
FIG. 12 is a front view of a carpet stretching tool according to an alternate embodiment of the present invention.

As illustrated in FIG. 7, and as stated above, the device 1 is configured to accommodate a variety of interchangeable tools. Accordingly, when a worker needs to switch tools using the device, the Ram 12 can simply be removed from one tool containing a first tool head (the cable burier 31 for example) and can be placed onto another tool containing a second tool head (such as the compactor tool head 50 for example).

Figure 13:
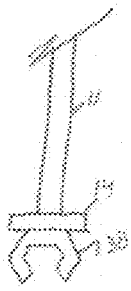
FIG. 13 is a front view of a wrench tool according to an alternate embodiment of the present invention.
Figure 14:
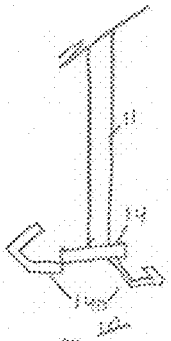
FIG. 14 is a front view of a stationary turbine blade remover and installer tool head according to an alternate embodiment of the present invention.

As can be readily discernable to one of skill in the art, the uses for this device are virtually limitless with application of new tool heads. For example, the tool 10 can include any generic construction tool heads such as an axe 80, chisel 90, hedger 100, tile stripper 110 or carpet stretcher 120 as illustrated in FIGS. 8-12. Moreover, the tool can also incorporate custom tool heads built to perform specialized tasks such as a specialized wrench 130 or stationary turbine blade remover 140, as illustrated in FIGS. 13-14. Each of FIGS. 8-14 also illustrating an attached base member 11 and an impact plate 14, the functions of which are described above with reference to FIG. 1.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. As such, this invention can be embodied in other forms without departing from the spirit or essential attributes thereof. Accordingly, reference should be made to the following claims, rather than to the foregoing specification, as indicating the scope of the invention.

What is claimed is:

1. An impact device comprising:

an interchangeable tool that includes an elongated square-shaped base member having a first end and a second end, at least one protrusion secured to the first end of the base member, an impact plate having a top surface that is secured to the second end of the base member, and a head unit secured to a bottom surface of the impact plate, said head unit being configured to interact with an external object; a hollow, square-shaped steel ram configured to slide along a length of the base member, said ram including a bottom end configured to deliver an impact force to the impact plate, and a plurality of openings laterally spaced and disposed along a side surface thereof; and a securing unit removably positioned within one of the plurality of openings, said securing unit openings and at least one protrusion forming a ram stop for defining a maximum separation distance between the bottom end of the ram and the impact plate during operation of the device, wherein the head unit is further configured to transfer the impact force from the impact plate to the external object.

2. The device of claim 1, wherein a portion of the ram further includes a rubber grip and a handle, and the top surface of the impact plate further includes a rubber sound dampening layer.

3. The device of claim 1 wherein said head unit includes a cable burier.

4. The device of claim 1 wherein said head unit includes a compactor.

5. The device of claim 1 wherein said head unit includes an axe.

6. The device of claim 1 wherein said head unit includes a chisel.

7. The device of claim 1 wherein said head unit includes a hedger.

8. The device of claim 1 wherein said head unit includes a tile and shingle stripper.

9. The device of claim 1 wherein said head unit further includes a magnetized portion.

10. The device of claim 9 wherein said head unit is interchangeable with a plurality of head unit types.

11. The device of claim 1 wherein each of the elongated base member, the at least one protrusion, the impact plate and the tool head are constructed to form a unitary steel element.

12. The device of claim 1, wherein the maximum separation distance of the ram and the impact plate is adjustable via the securing unit and the plurality of openings.

13. The device of claim 1 wherein the ram further includes weighted elements configured to increase a momentum force on the impact plate.

14. An impact device comprising:

an interchangeable tool that includes an elongated square-shaped base member having a first end and a second end, at least one protrusion secured to the first end of the base member, an impact plate having a top surface that is secured to the second end of the base member, and a head unit secured to a bottom surface of the impact plate, said head unit including a magnetic element configured to secure the device to a metallic foreign object; a hollow, square-shaped steel ram configured to slide along a length of the base member, said ram including a bottom end configured to deliver an impact force to the impact plate, and a plurality of openings laterally spaced and disposed along a side surface thereof; and a securing unit removably positioned within one of the plurality of openings, said securing unit openings and at least one protrusion forming a ram stop for defining a maximum separation distance between the bottom end of the ram and the impact plate during operation of the device, wherein the head unit is further configured to transfer the impact force from the impact plate to the foreign object.

* * * * *